US007739841B1

(12) United States Patent
Puckett

(10) Patent No.: US 7,739,841 B1
(45) Date of Patent: Jun. 22, 2010

(54) FRAMING IN A BUILDING ASSEMBLY

(75) Inventor: Douglas S. Puckett, Baxter Springs, KS (US)

(73) Assignee: Excel Metal Building Systems, Inc., Baxter Springs, KS (US)

( * ) Notice: Subject to any disclaimer, the term of this patent is extended or adjusted under 35 U.S.C. 154(b) by 0 days.

(21) Appl. No.: 12/070,270

(22) Filed: Feb. 15, 2008

(51) Int. Cl.
*E04B 7/04* (2006.01)
*E04B 7/08* (2006.01)
*E04H 12/00* (2006.01)

(52) U.S. Cl. ..... 52/93.1; 52/93.2; 52/639; 52/655.1; 52/653.2

(58) Field of Classification Search ..... 52/93.1, 52/93.2, 222, 273, 639, 643, 712, 653.2, 52/655.1, 702, 653.1
See application file for complete search history.

(56) References Cited

U.S. PATENT DOCUMENTS 1,369,837 A * 3/1921 Price ..... 403/402
2,768,434 A * 10/1956 Taylor ..... 29/525.04
3,184,012 A 5/1965 Fujishima et al.
3,285,636 A * 11/1966 Hoyle, Jr. ..... 403/230
3,309,120 A * 3/1967 Wada ..... 403/231
3,333,875 A * 8/1967 Tracy ..... 403/170
3,425,720 A * 2/1969 Spane ..... 403/247
3,486,278 A * 12/1969 Woods ..... 52/81.3
3,688,461 A * 9/1972 Rensch et al. ..... 52/653.1
3,829,999 A * 8/1974 Bernstein ..... 40/605
3,836,270 A * 9/1974 Chambers ..... 403/218
4,076,432 A * 2/1978 Glaser ..... 403/176
4,260,276 A * 4/1981 Phillips ..... 403/172
4,271,654 A * 6/1981 Jungbluth ..... 52/637
4,275,534 A * 6/1981 Porter ..... 52/82
4,315,386 A * 2/1982 Clarke ..... 52/93.1
4,342,177 A 8/1982 Smith
4,357,118 A * 11/1982 Murray ..... 403/172
4,395,154 A * 7/1983 Phillips et al. ..... 403/172
4,491,437 A * 1/1985 Schwartz ..... 403/172
4,773,192 A 9/1988 Andrews
4,809,480 A 3/1989 Hale
4,888,921 A * 12/1989 Markham ..... 52/63
4,974,387 A * 12/1990 Dufour ..... 52/639
5,040,343 A * 8/1991 Wolf ..... 52/93.1
5,088,245 A * 2/1992 Anderson ..... 52/82
5,435,110 A * 7/1995 Stol et al. ..... 52/655.1
5,577,353 A * 11/1996 Simpson ..... 52/92.2

(Continued)

*Primary Examiner*—Richard E Chilcot, Jr.
*Assistant Examiner*—Mark R Wendell
(74) *Attorney, Agent, or Firm*—William R. Sharp

(57) ABSTRACT

The invention relates to framing for a ready to assemble building, which employs a novel connector for connection of a column to a rafter ("knee connector") or a rafter to another rafter ("peak connector"). The connector includes a hub comprising multiple substantially planar hub portions. The hub portions include a first hub portion, a second hub portion integrally connected to the first hub portion so as to define an acute angle with respect thereto, and at least one other hub portion integrally connected between the first and second hub portions. The connector further includes first and second legs comprised of elongated plates. The first leg perpendicularly extends outwardly from the first hub portion, and the second leg perpendicularly extends outwardly from the second hub portion. Each leg has a plurality of holes therethrough for alignment with corresponding holes in a structural member, preferably light gauge C-channel. Suitable fasteners are receivable through holes in a leg as aligned with corresponding holes in a structural member.

10 Claims, 3 Drawing Sheets

U.S. PATENT DOCUMENTS

| | | | | |
|---|---|---|---|---|
| 5,600,924 | A | 2/1997 | Forsberg | |
| 5,609,004 | A * | 3/1997 | Kreis | 52/655.1 |
| 5,628,375 | A * | 5/1997 | Daly | 175/227 |
| 5,660,005 | A * | 8/1997 | Tacoma | 52/93.2 |
| 5,671,580 | A * | 9/1997 | Chou | 52/656.4 |
| 5,966,890 | A * | 10/1999 | Inman | 52/653.2 |
| 5,983,577 | A * | 11/1999 | Hays | 52/79.1 |
| 6,212,850 | B1 * | 4/2001 | Branson | 52/745.01 |
| 6,276,094 | B1 * | 8/2001 | Hays | 52/79.1 |
| 6,293,057 | B1 | 9/2001 | Hays | |
| 6,327,823 | B1 * | 12/2001 | Emms | 52/93.2 |
| 6,701,691 | B1 * | 3/2004 | Niiduma | 52/745.2 |
| 6,810,628 | B2 | 11/2004 | Emms | |
| 7,024,825 | B2 * | 4/2006 | Kebeli | 52/93.1 |
| 7,076,923 | B2 * | 7/2006 | Seldon | 52/93.2 |
| 7,475,517 | B2 * | 1/2009 | Kawai et al. | 52/702 |
| 2002/0112439 | A1 * | 8/2002 | Rosas | 52/712 |
| 2002/0116893 | A1 * | 8/2002 | Waldrop | 52/731.4 |
| 2002/0189191 | A1 * | 12/2002 | Strassle et al. | 52/655.2 |
| 2004/0049992 | A1 * | 3/2004 | Seavy | 52/79.1 |
| 2004/0107666 | A1 * | 6/2004 | Fritsche et al. | 52/633 |

* cited by examiner

FRAMING IN A BUILDING ASSEMBLY

BACKGROUND OF THE INVENTION

The invention relates to combinations for use in the framing of a building assembly, particularly of the type which employs steel structural members.

There are basically two types of steel frame buildings. These include those buildings constructed from welded I-beams, and buildings assembled from light gauge (i.e. 12-16 gauge) steel members. The latter type of steel buildings is increasingly popular, primarily because the average person, using only basic tools, can typically assemble such buildings himself or herself without the need for hiring a construction contractor, thus greatly reducing costs.

Light gauge steel buildings on the market today typically use a truss design, for at least the intermediate frames, in order to achieve the strength and structural integrity required for safe construction, especially in areas where snow and ice loads on the roof of the building have the potential of becoming significant. A truss employs a bottom chord extending across the width of the building, as well as a vertical brace member connected between the bottom chord and the peak at which a pair of rafters are joined. Although the truss construction does not usually require any interior columns, thus providing a clear span horizontally, the necessity of the bottom chord and associated bracing limits the available vertical space within the building.

SUMMARY OF THE INVENTION

It is, therefore, an object of the invention to provide framing for a building (i.e. steel) that can be assembled from light gauge structural members without requiring trusses or interior columns.

The above object is realized by using the following combination of components for column-rafter and rafter-rafter connections: a metal hub comprised of multiple substantially planar hub portions having respective interior and exterior surfaces, the hub portions including a first hub portion, a second hub portion integrally connected to the first hub portion so as to define an internal acute angle with respect thereto, and at least one additional hub portion integrally connected between the first and second hub portions so that the multiple hub portions together define a closed three dimensional geometric figure, and further have their respective interior surfaces defining an interior space therein through which a central axis extends so as to be substantially parallel to each of the hub portions; a first leg comprised of an elongated and substantially planar metal plate having a plurality of holes therethrough, opposing inner and outer ends, and a longitudinal axis, the first leg having its inner end integrally connected to the first hub portion so as to extend outwardly from the exterior surface thereof in a planar orientation substantially perpendicular to the central axis of the hub, with the longitudinal axis of the first leg being substantially perpendicular to the first hub portion; and a second leg also comprised of an elongated and substantially planar metal plate having a plurality of holes therethrough, opposing inner and outer ends, and a longitudinal axis, the second leg having its inner end integrally connected to the second hub portion so as to extend outwardly from the exterior surface thereof in a planar orientation substantially perpendicular to said central axis and substantially coplanar with the first leg, the longitudinal axis of the second leg being substantially perpendicular to the second hub portion.

A first structural member is connected to a second structural member with suitable fasteners as received through aligned holes in the first leg and first structural member, and with additional fasteners similarly received through aligned holes in the second leg and second structural member. The connector combination of the hub and pair of legs, as an integral unit in conjunction with the associated fasteners, provides a strong and reliable connection between the two structural members, such as an outer column and rafter (i.e. knee connection) or a pair of rafters (i.e. peak connection). In either type of connection, it is important to note that the connector of the invention requires no additional stiffening or reinforcing hardware.

The invention is most commonly applied to smaller buildings having widths between 12 and 40 feet. Such a building as assembled from light gauge structural members in accordance with the invention does not require trusses or interior columns, thereby maximizing useable space therein. Furthermore, the invention allows an overhead door to be installed in a sidewall, which is not generally feasible in light gauge buildings of the prior art, whose frames cannot typically be over about 10 feet apart.

DETAILED DESCRIPTION OF THE INVENTION

Figure 1:
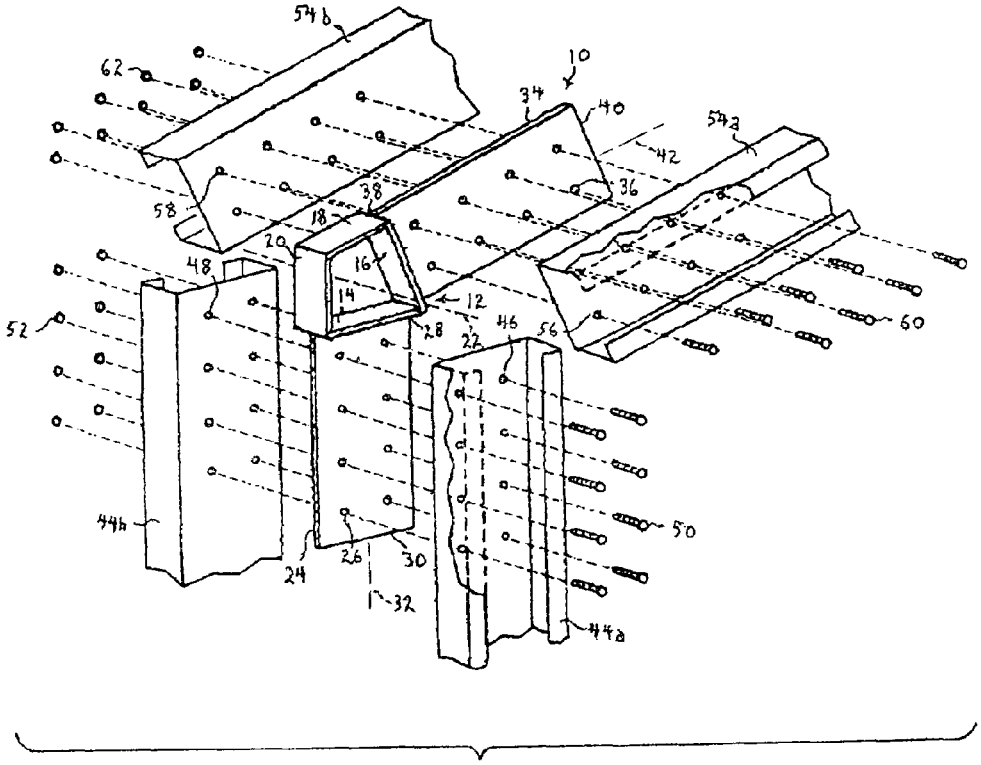
FIG. 1 is an exploded (i.e. disassembled) view of a pair of structural members and a connector for connecting the members together.

All components shown in the drawings are preferably comprised of steel. It is possible that an alternative metal or metal alloy could be employed if it is suitably strong and durable. Only frames for use in an easily assembled steel building are shown in the drawings. Various other components employed in this type of steel building, such as girts and purlins, are not shown for the sake of clarity and simplicity, since such other components are not relevant to the invention.

with respect to terminology as used herein and in the appended claims, any two members that are "integrally connected" means that the members are fixedly connected (i.e. by welding) to one another or are integral with one another. In addition, each "C-channel" is understood to comprise a web, opposing flanges integral with and at right angles to the web, and opposing lips integral with and at right angles to the corresponding flanges.

Referring to FIG. 1, a connector 10 includes a metal hub 12 that is comprised of multiple substantially planar hub portions having respective interior and exterior surfaces. The hub portions include a hub portion 14, a hub portion 16 integrally connected to hub portion 14, and at least one additional hub portion integrally connected between hub portions 14 and 16 so that the multiple hub portions together define a closed three dimensional geometric figure. In the particular embodiment illustrated in FIG. 1, there are two additional hub portions, 18 and 20, that are integrally connected to one another. Accordingly, the multiple hub portions of hub 12 define a geometric figure having a quadrilateral (i.e. four sided) cross section. FIG. 1 further shows that the interior surfaces of the hub portions define an interior space therein through which a central axis 22 extends so as to be substantially parallel to each of the hub portions. Each hub portion preferably comprises a metal plate having opposing edges. Pairs of integrally connected hub portions (14 and 16, 16 and 18, 18 and 20, and 20 and 14) are integrally connected to one another along or immediately adjacent to respective edges thereof.

Connector 10 further includes a first leg 24 comprised of an elongated and substantially planar metal plate having a plurality of holes 26 therethrough, an inner end 28, an opposing outer end 30, and a longitudinal axis 32. Leg 24 has its inner end 28 integrally connected to hub portion 14 so as to extend outwardly from the exterior surface thereof in a planar orientation substantially perpendicular to central axis 22. Leg 24 is further oriented so that its longitudinal axis 32 is substantially perpendicular to hub portion 14.

A second leg 34 is also comprised of an elongated and substantially planar metal plate having a plurality of holes 36 therethrough, an inner end 38, an opposing outer end 40, and a longitudinal axis 42. Leg 34 has its inner end 38 integrally connected to hub portion 16 so as to extend outwardly from the exterior surface thereof in a planar orientation substantially perpendicular to central axis 22 and substantially coplanar with leg 24. Leg 34 is further oriented so that its longitudinal axis 42 is substantially perpendicular to hub portion 16.

C-channels 44*a* and 44*b*, as partially shown in FIG. 1, are the component parts of an elongated first structural member 44. C-channel 44*a* has a plurality of holes 46 through its web and adjacent to its upper end. A portion of C-channel 44*a* is broken away in order to show four of holes 46 in the view of FIG. 1. In a manner similar to C-channel 44*a*, C-channel 44*b* has a plurality of holes 48 adjacent to its upper end. As shown, holes 46 and 48 are both positioned to allow alignment with each other as well as with holes 26 in leg 24. A plurality of bolts 50 are receivable through corresponding aligned holes in C-channel 44*a*, leg 24, and C-channel 44*b*. Nuts 52 are adapted to be threadedly received onto corresponding bolts 50 upon their receival through the above-mentioned holes.

C-channels 54*a* and 54*b*, as partially shown in FIG. 1, are the component parts of an elongated second structural member 54. C-channel 54*a* has a plurality of holes 56 through its web and adjacent to that end which is shown. A portion of C-channel 54*a* is broken away to reveal four of holes 56. C-channel 54*b* similarly has a plurality of holes 58 adjacent to one end thereof. As shown, holes 56 and 58 are both positioned to allow alignment with each other as well as with holes 36 in leg 34. A plurality of bolts 60 are receivable through corresponding aligned holes in C-channel 54*a*, leg 34, and C-channel 54*b*. Nuts 62 are adapted to be threadedly received onto corresponding bolts 60 upon their receival through the above-mentioned holes.

Figure 2:
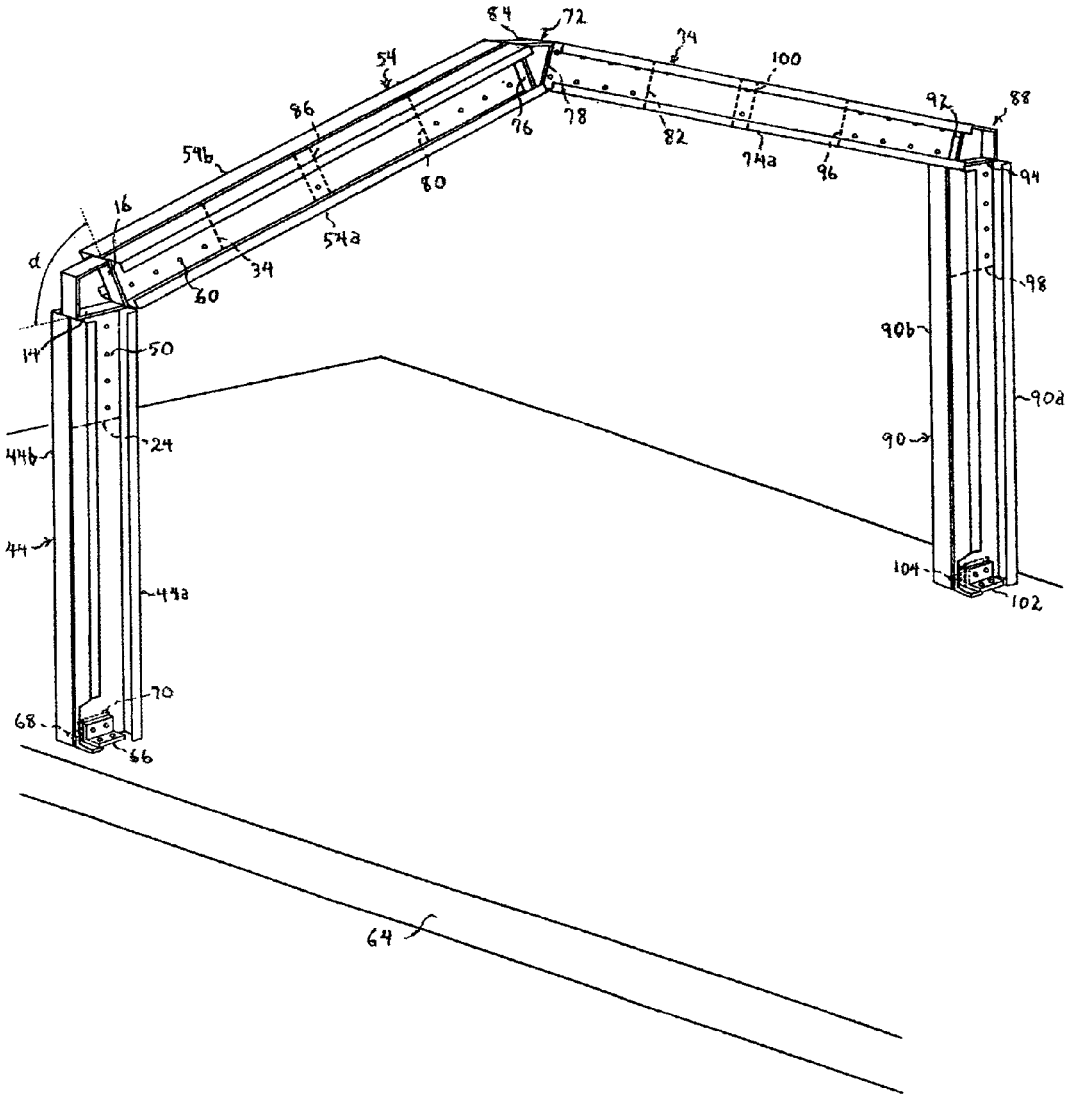
FIG. 2 is a perspective view of an intermediate frame assembled in accordance with the invention.

Referring to FIG. 2, the illustrated intermediate frame includes the above described connector as a "knee" connector for connecting structural members 44 and 54 as a substantially vertical column and inclined rafter, respectively. C-channels 44*a* and 44*b* of structural member 44, as shown in a back to back relationship, are securely fastened to a suitable concrete slab 64 with respective brackets 66 and 68. C-channels 54*a* and 54*b* are also oriented in a back to back relationship. With respect to the connector hub, hub portion 14 is shown as defining an internal acute angle $\alpha$ (less than 90°) with respect to hub portion 16. Hub portions 14 and 16 have been extended with broken lines to more easily indicate the internal angle $\alpha$.

Now describing assembled structural member 44 in detail, leg 24 (indicated by broken lines at its outer end) is positioned between C-channels 44*a* and 44*b* of structural member 44. There is a small but uniform separation between and along C-channels 44*a* and 44*b* due to the thickness of leg 24 (about ¼ inch) adjacent to the upper end of structural member 44, and due to the equivalent thickness of a spacer plate 70 as positioned between C-channels 44*a* and 44*b*, and between brackets 66 and 68, adjacent to the lower end of structural member 44. Bolts 50, as received through aligned holes in the manner discussed above, and associated nuts (FIG. 1) secure the C-channels of structural member 44 to leg 24 in the above-mentioned back to back relationship. As thus secured to leg 24, structural member 44 is longitudinally aligned with leg 24. FIG. 2 further shows that the upper ends of C-channels 44*a* and 44*b*, as constituting the upper end of structural member 44, are immediately adjacent to or in abutment with the exterior surface of hub portion 14.

with respect to structural member 54, leg 34 is positioned between C-channels 54*a* and 54*b* of this structural member. There is a small but uniform separation between and along C-channels 54*a* and 54*b* due to the thickness of leg 34 and other members described below. Bolts 60, as received through aligned holes in the manner described previously, and associated nuts (FIG. 1) secure the C-channels of structural member 54 to leg 34 in back to back relationship. As thus secured to leg 34, the elongated structural member 54 is longitudinally aligned with leg 34. The lower ends of C-channels 54*a* and 54*b*, as constituting the lower end of the structural member 54, are immediately adjacent to or in abutment with the exterior surface of hub portion 16.

The intermediate frame of FIG. 2 further includes a "peak" connector 72 for connecting structural member 54 and a structural member 74 as inclined rafters. Structural member 74 includes back to back C-channels and is essentially identical in structure to structural member 54. Only one of the C-channels of structural member 74, indicated at 74*a*, is visible in FIG. 2.

Connector 72 is similar to the previously described connector insofar as having a metal hub comprised of multiple substantially planar hub portions, including a first hub portion 76 and a second hub portion 78 integrally connected to hub portion 76 so as to define an internal acute angle with respect thereto. Connector 72 further includes a first leg 80 and a second leg 82 outwardly extending from the exterior surfaces of hub portions 76 and 78, respectively. However, connector 72 includes only one additional hub portion 84 integrally connected between hub portions 76 and 78. Consequently, the multiple hub portions together define a geometric figure having a triangular cross section.

Legs 80 and 82 are positioned between the C-channels of respective structural members 54 and 74 adjacent to their upper ends. A spacer plate 86, having the same thickness as legs 34 and 80, is received and bolted in place between C-channels 54*a* and 54*b* at the approximate longitudinal center of structural member 54. Bolts with associated nuts are employed to secure structural members 54 and 74 to respective legs 80 and 82 in the manner described previously. Accordingly, structural members 54 and 74 are longitudinally aligned with corresponding legs 80 and 82, and have their upper ends immediately adjacent to or in abutment with the exterior surfaces of the hub portions from which the legs extend.

Knee connector 88 is further provided for connecting structural member 74 and a structural member 90 as an inclined rafter and vertical column, respectively. Structural member 90 includes back to back C-channels 90*a* and 90*b*, and is substantially identical to structural member 44. Knee connector 88 is substantially identical to the above described knee connector, and has hub portions 92 and 94 from which legs 96 and 98 respectively extend. Leg 96 is received between the C-channels of structural member 74 adjacent to its lower end, and leg 98 is received between the C-channels of structural member 90 adjacent to its upper end. A spacer plate 100, having the same thickness as legs 82 and 96, is received and bolted in place between the C-channels of structural member 74. Bolts and associated nuts are employed to secure structural member 74 to leg 96, and structural member 90 to leg 98. Structural members 74 and 90 are oriented and positioned relative to corresponding legs and hub portions of connector 88 in essentially the same manner that structural members 54 and 44 are oriented and positioned relative to the other knee connector. Finally in describing FIG. 2, C-channels 90*a* and 90*b* of structural member 90 are securely fastened to concrete slab 64 with respective brackets 102 and 104.

Figure 3:
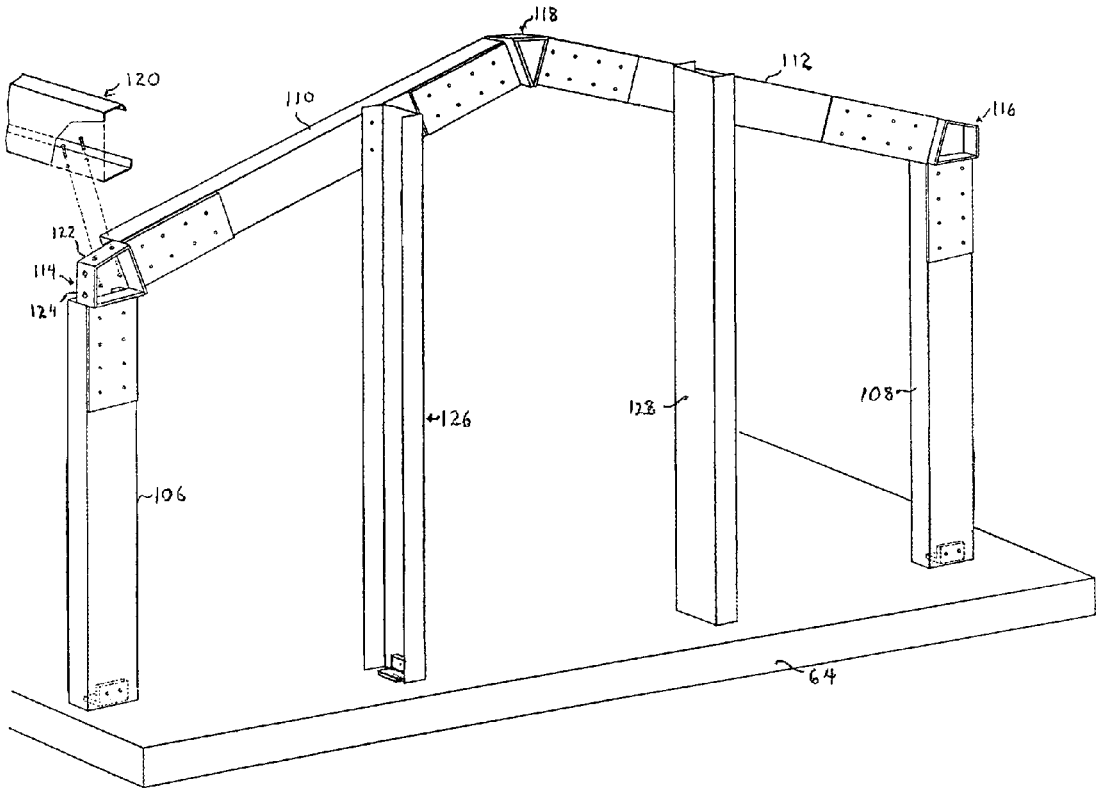
FIG. 3 is a perspective vies of an end frame assembled in accordance with the invention.

Referring to FIG. 3, the illustrated end frame includes a pair of structural members 106 and 108 as outer vertical columns mounted with brackets to slab 64, and further includes a pair of inclined structural members 110 and 112 as rafters. Each of the structural members includes a single C-channel. A pair of knee connectors 114 and 116 are substantially identical to the knee connectors in the previously described embodiment, and a peak connector 118 is essentially identical to the peak connector in such embodiment. Knee connector 114 connects structural member 106, adjacent to its upper end, to structural member 110 adjacent to its lower end. Peak connector 118 connects structural members 110 and 112 adjacent to their upper ends. Knee connector 116 connects structural member 112, adjacent to its lower end, to structural member 108 adjacent to its upper end.

An eave strut 120 is shown as removed from its mounted position on knee connector 114. Eave strut 120 has a pair of holes through one of its flanges. A pair of bolts are receivable through such holes and an aligned pair of holes in hub portion 122. Two nuts are threadedly receivable upon corresponding bolts, thus fixedly connecting eave strut 120 to knee connector 114. Another pair of holes is provided through hub portion 124 to allow future addition of an auxiliary structure such as a lean-to. Of course, although not shown in FIG. 3, knee connector 116 would also be provided with holes to allow mounting of an eave strut and addition of an auxiliary structure. Since inner columns do not present any problems for an end frame, two structural members 126 and 128 are provided to serve as inner columns in the illustrated embodiment. Structural members 126 and 128 have corresponding flanges fixedly connected to structural members 110 and 112, respectively, with suitable bolts and nuts.

As should be readily apparent from the drawings and above description, framing for a building in accordance with the invention can be easily and quickly assembled by the average "do-it-yourselfer" without the need for any special tools. In addition to the absolute minimum number of parts required, particular types of connectors (i.e. knee and peak) are interchangeable and capable of being turned one way or the other to further facilitate ease of assembly.

Obviously, many modifications and variations of the present invention are possible in light of the above teachings. It is, therefore, to be understood that within the scope of the appended claims the invention can be practiced otherwise than as specifically described.

The invention claimed is:

1. A combination for use in a frame of a building assembly, comprising:

a metal hub comprised of multiple substantially planar hub portions having respective interior and exterior surfaces, said hub portions including a first hub portion, a second hub portion integrally connected to the first hub portion so as to define an internal acute angle with respect thereto, and at least one additional hub portion integrally connected between the first and second hub portions so that the multiple hub portions together define a closed three dimensional geometric figure and have their respective interior surfaces defining an interior space therein through which a central axis extends so as to be substantially parallel to each of the hub portions;

a first leg comprised of only a single elongated and substantially planar metal plate having a plurality of holes therethrough, opposing inner and outer ends, and a longitudinal axis, the exterior surface of the first hub portion having only the inner end of the first leg integrally connected thereto so as to extend outwardly therefrom in a planar orientation substantially perpendicular to said central axis, with the longitudinal axis of the first leg being substantially perpendicular to the first hub portion; and a second leg also comprised of only a single elongated and substantially planar metal plate having a plurality of holes therethrough, opposing inner and outer ends, and a longitudinal axis, the exterior surface of the second hub portion having only the inner end of the second leg integrally connected thereto so as to extend outwardly therefrom in a planar orientation substantially perpendicular to said central axis and substantially coplanar with the first leg, the longitudinal axis of the second leg being substantially perpendicular to the second hub portion.

2. A combination as recited in claim 1 wherein each hub portion comprises a metal plate having opposing edges, and wherein for each pair of integrally connected hub portions, such hub portions are integrally connected to one another along or immediately adjacent to respective edges thereof.

3. A combination as recited in claim 1 further comprising: an elongated first structural member having opposing ends and a plurality of holes therethrough adjacent to one end thereof; a plurality of first fasteners received through the corresponding plurality of holes in the first structural member and through the corresponding plurality of holes in the first leg as aligned with the holes in the first structural member, such that the elongated first structural member is secured to and longitudinally aligned with the first leg; an elongated second structural member having opposing ends and a plurality of holes therethrough adjacent to one end thereof; and a plurality of second fasteners received through the corresponding plurality of holes in the second structural member and through the corresponding plurality of holes in the second leg as aligned with the holes in the second structural member, such that the elongated second structural member is secured to and longitudinally aligned with the second leg.

4. A combination as recited in claim 3 wherein the first structural member is a substantially vertical column and the second structural member is a rafter, and wherein the hub and first and second legs as connected thereto constitute a knee connector in which the geometric figure defined by the hub portions has a quadrilateral cross section, such that said at least one additional hub portion includes a pair of third and fourth hub portions integrally connected to one another.

5. A combination as recited in claim 3 wherein the first and second structural members are rafters, and wherein the hub and first and second legs as connected thereto constitute a peak connector in which the geometric figure defined by the hub portions has a triangular cross section, such that said at least one additional hub portion includes a single third hub portion.

6. A combination as recited in claim 3 wherein each of the first and second structural members comprises at least one C-channel having a web, wherein the plurality of holes in each of the structural members comprises holes in the web of the C-channel as aligned with those holes in the corresponding leg.

7. A combination as recited in claim 3 wherein the first structural member, as secured to the first leg, has said one end thereof immediately adjacent to or in abutment with the exterior surface of the first hub portion from which the first leg extends, and wherein the second structural member, as secured to the second leg, has said one end thereof immediately adjacent to or in abutment with the exterior surface of the second hub portion from which the second leg extends.

8. A combination as recited in claim 6 wherein said at least one C-channel includes a pair of back to back C-channels with holes in their respective webs being aligned with each other as well as with those holes in the corresponding leg that is received between the C-channels.

9. A combination for use in a frame of a building assembly, comprising:

a metal hub comprised of multiple substantially planar hub portions having respective interior and exterior surfaces, said hub portions including a first hub portion, a second hub portion integrally connected to the first hub portion so as to define an internal acute angle with respect thereto, and at least one additional hub portion integrally connected between the first and second hub portions so that the multiple hub portions together define a closed three dimensional geometric figure and have their respective interior surfaces defining an interior space therein through which a central axis extends so as to be substantially parallel to each of the hub portions;

a first leg comprised of an elongated and substantially planar metal plate having a plurality of holes therethrough, a longitudinal axis, longitudinally opposed inner and outer ends, and a pair of transversely opposed free edges extending between the inner and outer ends of the first leg, said first leg having its inner end integrally connected to the first hub portion so as to extend outwardly from the exterior surface thereof in a planar orientation substantially perpendicular to said central axis, with the longitudinal axis of the first leg being substantially perpendicular to the first hub portion; and a second leg also comprised of an elongated and substantially planar metal plate having a plurality of holes therethrough, a longitudinal axis, longitudinally opposed inner and outer ends, and a pair of transversely opposed free edges extending between the inner and outer ends of the second leg, said second leg having its inner end integrally connected to the second hub portion so as to extend outwardly from the exterior surface thereof in a planar orientation substantially perpendicular to said central axis and substantially coplanar with the first leg, the longitudinal axis of the second leg being substantially perpendicular to the second hub portion.

10. A combination for use in a frame of a building assembly, comprising:

a metal hub comprised of multiple substantially planar hub portions having respective interior and exterior surfaces, said hub portions including a first hub portion, a second hub portion integrally connected to the first hub portion so as to define an internal acute angle with respect thereto, and at least one additional hub portion integrally connected between the first and second hub portions so that the multiple hub portions together define a closed three dimensional geometric figure and have their respective interior surfaces defining an interior space therein through which a central axis extends so as to be substantially parallel to each of the hub portions, the hub further having axially opposed open sides communicating with the interior space defined therein so that the hub is open from one side to the other side;

a first leg comprised of an elongated and substantially planar metal plate having a plurality of holes therethrough, opposing inner and outer ends, and a longitudinal axis, the first leg having its inner end integrally connected to the first hub portion so as to extend outwardly from the exterior surface thereof in a planar orientation substantially perpendicular to said central axis, with the longitudinal axis of the first leg being substantially perpendicular to the first hub portion; and a second leg also comprised of an elongated and substantially planar metal plate having a plurality of holes therethrough, opposing inner and outer ends, and a longitudinal axis, the second leg having its inner end integrally connected to the second hub portion so as to extend outwardly from the exterior surface thereof in a planar orientation substantially perpendicular to said central axis and substantially coplanar with the first leg, the longitudinal axis of the second leg being substantially perpendicular to the second hub portion.

* * * * *